US009943853B2

(12) United States Patent
Marshall

(10) Patent No.: US 9,943,853 B2
(45) Date of Patent: Apr. 17, 2018

(54) PULVERIZING APPARATUS AND METHOD OF PULVERIZING ROCKS

(71) Applicant: Michael Marshall, Morristown, AZ (US)

(72) Inventor: Michael Marshall, Morristown, AZ (US)

( * ) Notice: Subject to any disclaimer, the term of this patent is extended or adjusted under 35 U.S.C. 154(b) by 417 days.

(21) Appl. No.: 14/445,657

(22) Filed: Jul. 29, 2014

(65) Prior Publication Data

US 2015/0196919 A1 Jul. 16, 2015

Related U.S. Application Data

(60) Provisional application No. 61/928,212, filed on Jan. 16, 2014.

(51) Int. Cl.

| | |
|---|---|
| ***B02C 17/00*** | (2006.01) |
| ***B02C 17/02*** | (2006.01) |
| ***B02C 17/20*** | (2006.01) |
| ***B02C 17/18*** | (2006.01) |
| ***B02C 17/24*** | (2006.01) |

(52) U.S. Cl.

CPC ..... *B02C 17/02* (2013.01); *B02C 17/1855* (2013.01); *B02C 17/20* (2013.01); *B02C 17/24* (2013.01)

(58) Field of Classification Search

CPC ..... B02C 17/02; B02C 17/20; B02C 17/24; B02C 17/183; B02C 17/1855

USPC ..... 241/170–171

See application file for complete search history.

(56) References Cited

U.S. PATENT DOCUMENTS

| | | | | | |
|---|---|---|---|---|---|
| 981,445 | A * | 1/1911 | Whitcomb | B02C 17/04 | 241/180 |
| 1,388,462 | A * | 8/1921 | Hardinge | B02C 17/20 | 144/208.7 |
| 1,427,234 | A * | 8/1922 | Sherban | B02C 17/06 | 241/43 |
| 1,430,432 | A * | 9/1922 | Bittner | B02C 17/04 | 241/176 |
| 1,431,475 | A * | 10/1922 | MacDonald | B02C 17/20 | 241/184 |
| 1,720,024 | A * | 7/1929 | Young | B02C 17/20 | 241/184 |
| 1,903,166 | A * | 3/1933 | Bryant | B02C 17/04 | 241/171 |

(Continued)

*Primary Examiner* — Faye Francis

(74) *Attorney, Agent, or Firm* — Global Intellectual Property Agency, LLC; Daniel Boudwin

(57) ABSTRACT

A rock crushing assembly is provided in the form of a pulverizing tumbler. The apparatus includes a faceted tumbler having a plurality of faceted end walls, a pair of parallel sidewalls, and an open interior. A power source and a drivetrain assembly attach to the sidewalls of the tumbler and rotate the same. Within the tumbler is adapted to be placed rocks and minerals to be pulverized, wherein pulverizing media is placed in the tumbler with the rocks to break down the rocks into fine, granular material. One of the end walls of the tumbler is removable to allow access to the tumbler interior. One or more gaps or apertures through one or more of the end walls allow the pulverized material to exit the tumbler during operation, thereby reducing build-up of loose material that can dampen impacts within the tumbler.

13 Claims, 5 Drawing Sheets

(56) References Cited

U.S. PATENT DOCUMENTS 1,946,511 A * 2/1934 Van Pelt ..... B02C 17/1855 241/182
2,069,731 A * 2/1937 Trumpler ..... B02C 17/20 241/184
2,074,233 A * 3/1937 Moussette, Sr. ..... B02C 17/18 209/290
2,098,054 A * 11/1937 McBerty ..... C22B 34/125 241/15
2,189,312 A * 2/1940 Frisch ..... B02C 17/00 209/139.1
2,376,820 A * 5/1945 Saumenicht ..... B02C 17/183 241/171
2,416,746 A * 3/1947 Gavin ..... B02C 17/04 209/214
2,431,870 A * 12/1947 Huenerfauth ..... B02C 17/20 241/184
2,545,202 A * 3/1951 Hartshorn ..... B02C 17/02 241/183
2,546,247 A * 3/1951 Wolf ..... B02C 17/02 209/270
2,675,967 A * 4/1954 Mote ..... B02C 17/18 241/171
2,681,210 A * 6/1954 Schaefer ..... B01F 9/02 241/176
2,978,850 A * 4/1961 Gleszer ..... B22F 3/00 451/330
3,027,105 A * 3/1962 Hall ..... B02C 17/20 241/171
3,146,557 A * 9/1964 Smith ..... B24B 31/02 241/176
3,513,604 A * 5/1970 Kobayashi ..... B24B 31/0218 451/32
3,542,300 A * 11/1970 Arthur ..... B02C 17/18 221/86
3,627,279 A * 12/1971 Barton ..... B65G 49/0463 366/153.3
3,728,825 A * 4/1973 Barrett, Jr. ..... B08B 7/0092 451/1
3,815,287 A * 6/1974 Walker ..... B24C 3/30 241/171
3,837,301 A * 9/1974 Falling ..... F23J 1/00 110/194
4,032,075 A * 6/1977 Tyer, Sr. ..... B02C 17/06 241/152.1
4,248,390 A 2/1981 Toole
4,638,600 A * 1/1987 Kobayashi ..... B24B 31/033 241/176
4,776,522 A * 10/1988 Hoffmann ..... B02C 17/166 241/176
5,064,292 A * 11/1991 Sutton ..... B28C 5/4268 241/171
5,360,174 A 11/1994 Persson
5,709,345 A * 1/1998 Yamamoto ..... F26B 3/205 241/17
5,848,755 A * 12/1998 Zickell ..... B02C 17/04 241/171
6,032,889 A 3/2000 Thrasher
6,123,279 A 9/2000 Stafford
6,189,819 B1 * 2/2001 Racine ..... B02C 17/04 241/176
6,547,171 B1 * 4/2003 Fontanille ..... B02C 17/1875 241/171
6,783,092 B1 8/2004 Robson
6,887,135 B2 * 5/2005 Lim ..... A63B 47/04 241/171
7,093,782 B2 * 8/2006 Artru ..... B02C 17/20 241/29
2010/0102151 A1 * 4/2010 Gerl ..... B02C 17/16 241/18

* cited by examiner

PULVERIZING APPARATUS AND METHOD OF PULVERIZING ROCKS

CROSS REFERENCE TO RELATED APPLICATION

This application claims the benefit of U.S. Provisional Application No. 61/928,212 filed on Jan. 16, 2014, entitled "Rock Crusher." The above identified patent application is herein incorporated by reference in its entirety to provide continuity of disclosure.

BACKGROUND OF THE INVENTION

Field of the Invention

The present invention relates to rock crushers and tumblers. More specifically, the present invention relates to a rock crushing apparatus and a method of pulverizing rocks into fine powder for subsequent sluicing.

Many rocks and ore contain fine particles of precious metals and other coveted minerals. However, these rocks generally need to be broken down or pulverized into smaller, more granular particles in order to separate the desired elements from the undesired earth or rock. This process was traditionally done by hand using a hammer or pickaxe, whereafter the rocks are broken down into the smaller sizes using impact tools as a means. Once the rock has been pulverized or broken down (either by hand or by alternate means), the process of sluicing is engaged to draw the desired minerals from the rock powder.

Rock crushing assemblies exist in the art and range in complexity and effectiveness. One drawback to most systems is that they require a user to remain present to supervise the crushing process, which is an unnecessarily frivolous task that takes time away from other, more productive activities. Furthermore rocks placed in some modern crushers must go through stages, or even run through a system multiple times before they produce particles of the desired size. The present invention is designed to address these drawbacks while maintaining a simple construction that can be easily maintained and refurbished after a period of use.

Specifically, the present invention provides a rock crushing assembly and method of pulverizing rocks that includes a powered tumbler and a pulverizing media therein. The tumbler is a rotary crushing assembly that rotates and includes faceted outer surfaces. A drivetrain rotates the tumbler at a given rotational velocity, which slings rocks toward the outer surfaces of the tumbler. Within the tumbler, the rocks are joined with a quantity of pulverizing media, which comprises a plurality of hardened spheres or pellets that have a higher hardness and stiffness than the rock being pulverized. The pulverizing media impacts the rocks as they rotate within the tumbler. Over a period of operation, the rocks are completely pulverized into a fine powder for subsequent extraction and further processing for precious minerals. To prevent the powder from softening impacts against the tumbler, the powder is allowed to escape the tumbler at a given point in its rotational sequence and into a collector. Overall, the system is user independent and requires no oversight once initiated.

Description of the Prior Art

Devices have been disclosed in the prior art that relate to rock crushing assemblies. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 6,032,889 to Thrasher, which discloses a rocker crusher device that comprises a rotor surrounded by a container, wherein the rotor is mounted to a vertical shaft that is supported via bearings. The shaft is driven such that the rotor rotates within the container. Rocks are fed into the rotor and slung from ports in the rotor to an impact anvil. Steel balls are positioned within the device to crush the rocks as they are slung against the impact anvil. While sharing the use of steel pulverizing balls, the structure and operation of the Thrasher assembly diverges significantly from that of the present invention. The present invention utilizes a tumbler with faceted outer surfaces and an open interior, wherein the inner surfaces and a pulverizing media is used break down larger rocks into finer powder.

Another device is U.S. Pat. No. 6,123,279 to Stafford, which discloses a rock crusher assembly that utilizes a cone having hardened, tapering inserts therein to crush rocks by way of impact. Rocks are placed on the cone, which in turn travel down the side of the cone along a crushing surface and into a tapered area. The hardened inserts act as pick-axes to shatter the rock, wherein the cone is rotating and the inserts impact the rocks as they move down the crushing surface. This assembly is effective for crushing rocks; however its method of crushing and the construction of the assembly of Stafford diverges from that provided herein. The Stafford device uses a crushing surface with projections. The present invention relates to a tumbler apparatus and a crushing media placed within the tumbler to break down large rocks into fine powder over a period of operation.

U.S. Pat. No. 6,783,092 to Robson discloses a rotary impact rock crusher that is disposed at an angle and includes an adjustable table that can update the angle while in operation. The device comprises a chamber with a rotor that slings rocks within the housing. Within the chamber is an anvil for crushing the moving rocks upon impact therewith. The anvil has rectangular cavities to break up the rocks, and the angular position of the anvil can be adjusted while the device is spinning. The Robson device utilizes a stationary anvil within the chamber as an impact surface. The present invention contemplates a spinning housing that utilizes faceted surfaces and a pulverizing media comprising hardened balls or pellets as a means of pulverizing the rocks into a powder.

Finally, U.S. Pat. No. 5,360,174 to Persson discloses a means of measuring the volume of a grinding charge in a rotating drum of a drum mill. The drum mill includes inward bars with sensors that can detect the load placed thereon. The load on the bars is used to calculate the amount of grinding charge therein. While disclosing a drum with a grinding charge, the Persson device fails to contemplate the faceted surfaces of the present drum or the grinding media used therein. Furthermore, the present invention contemplates a means of dispensing small quantities of pulverized rock from the drum during operation, thereby eliminating any impact attenuation or damping that powder can provide within the tumbler during operation.

The present invention provides a rock crushing and a mineral pulverizing assembly that utilizes a faceted tumbler and a hardened pulverizing media within the tumbler to break down larger rocks into granular material. The tumbler rotates and the rocks impact the pulverizing media and the faceted interior surfaces of the tumbler. After a period of operation, the end result is a granular material that can be processed for retrieving precious mineral deposits therein.

The granular material is allowed to escape the tumbler during operation, thereby preventing fine powder build-up therein and maintaining high energy impacts between the rocks, tumbler and the pulverizing media.

It is submitted that the present invention is substantially divergent in design elements from the prior art, and consequently it is clear that there is a need in the art for an improvement to existing rock pulverizing assemblies. The present invention offers a simple, yet elegant solution that can easily be maintained and used on a continual basis to reduce rocks into a fine powder for further mineral extraction processes. In this regard the instant invention substantially fulfills these needs.

SUMMARY OF THE INVENTION

In view of the foregoing disadvantages inherent in the known types of rock pulverizing assemblies now present in the prior art, the present invention provides a new assembly that can be utilized for pulverizing rocks into a fine powder using a tumbler and a replaceable pulverizing media, whereby the end result in a fine powder that can be processed for precious minerals.

It is therefore an object of the present invention to provide a new and improved rock pulverizing assembly that has all of the advantages of the prior art and none of the disadvantages.

It is another object of the present invention to provide a rock pulverizing assembly comprising a faceted pulverizing tumbler, wherein the shape of the tumbler is used to maximize the energy of impacts with the rocks and pulverizing media placed therein.

Another object of the present invention is to provide a rock pulverizing assembly that can operate largely without user oversight once the process is initiated, wherein a quantity of rocks are reduced to a fine powder over a period of time and without continual supervision.

Yet another object of the present invention is to provide a rock pulverizing assembly that regulates the effectiveness of the tumbler by allowing pulverized rocks in the form of fine powder to escape the tumbler while in operation, thereby preventing a build-up of material that can reduce the effectiveness of the tumbler and the pulverizing media.

Another object of the present invention is to provide a rock pulverizing assembly that utilizes a pulverizing media comprising a plurality of hardened pellets or spheres that form discrete objects that break apart the rocks into smaller proportions when impacted or when sandwiched between the pellets and the tumbler walls.

Another object of the present invention is to provide a pulverizing media having a higher hardness and failure stress than the mineral rocks to be pulverized, whereby the rocks shatter or break apart when impacted by the pulverizing media.

Another object of the present invention is to provide a rock pulverizing assembly that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
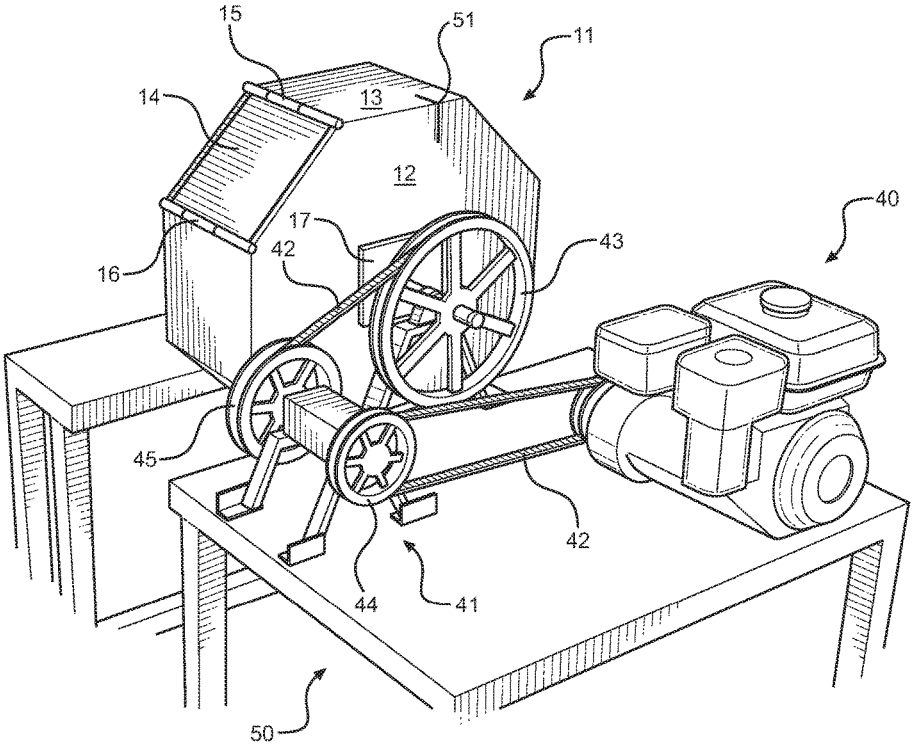
FIG. 1 shows a perspective view of the rock pulverizing assembly of the present invention.

Reference is made herein to the attached drawings. Like reference numerals are used throughout the drawings to depict like or similar elements of the rock pulverizing assembly of the present invention. For the purposes of presenting a brief and clear description of the present invention, the preferred embodiment will be discussed as used for reducing mineral rocks into fine powder for further processing. The figures are intended for representative purposes only and should not be considered to be limiting in any respect.

Referring now to FIG. 1, there is shown a perspective view of the pulverizing assembly of the present invention. The assembly comprises a rock crushing tumbler 11 that comprises a faceted shape having an internal volume and a plurality of walls. A first and second of sidewall 12 form the sides of the tumbler 11 and are affixed to the output 17 of the pulverizing assembly power source 40 and drivetrain 41. The power source 40 provides power in the form of rotational energy, whereby the drivetrain assembly 41 is used (if necessary) to reduce the rotational speed of the input to one that is suitable for the rock pulverizing operation at its output 17.

The tumbler 11 is used to support mineral rocks to be reduced, along with a pulverizing media that is placed therein with the rocks. The pulverizing media clashes and impacts the rocks as the tumbler 11 rotates, while the faceted shape of the tumbler increases the energy of the impacts when the rocks impact the inner walls thereof. The rocks and the pulverizing media cannot nestle into any curved portion, therefore the impacts are abrupt and cause a sharp change in momentum that causes stress on the rocks, pulverizing them into smaller proportions and eventually into a fine powder.

The tumbler 11 is comprised of a faceted shape with a pair of sidewalls 12 and a plurality of end walls 13 disposed therebetween. The end walls 13 are joined to one another at an angle (shown in FIG. 4, 52) to form a faceted shape, while the end walls 13 and the sidewalls 12 are joined at a right angle 51. The assembly is preferably devoid of rounded edges or contours. As shown in FIG. 1, each of the pair of sidewalls 12 and each of the plurality of end walls 13 lie in separate planes. In the illustrated embodiment, the pair of sidewalls 12 occupy parallel vertical planes, whereas each of the plurality of end walls 13 occupy a separate plane offset from the planes of adjacent end walls 13 by an angle (shown in FIG. 4, 52). Furthermore, one of the end walls forms an access door 14 such that the enclosed interior volume of the tumbler 11 is accessible. The access door may be completely removable or is hingedly attached to an adjacent end wall using a hinge joint 14 and a securing fastener 15. The fastener 15 secures the door 14 in a closed state for operation. The configuration of the fastener 15 may take on several forms, and is presented herein as a pin lock joint by way of example. Additionally provided on the tumbler may be one or more repair access doors along the sidewalls 12, which allow routine maintenance of the tumbler and access to its interior through the sidewalls 12 thereof.

The tumbler 11 is preferably mounted from a workstation 50 or similar support structure, wherein the first and second sidewall 12 are rotatable supported by about the central axis of the tumbler. Off-axis mounting is also contemplated to increase pulverizing effectiveness; however harmonics of the overall assembly and stress on the power source 40 and drivetrain 41 may favor a more balanced support. The power input 40 is preferably an internal combustion engine or electric motor that drives a belt pulley 42 or chain. The power input 40 may directly secure to the tumbler 11, however it is contemplated and shown effective to reduce the speed of the power input 40 by using a drivetrain assembly 41.

The drivetrain assembly 41 comprises a plurality of gears or pulley wheels that are used to reduce the speed of the input to one that is desirable at the output in connection with the tumbler 11. Effective prototypes have shown that a tumbler rotational speed of 21 to 24 revolutions per minute (RPM) is an effective for processing a volume of rocks in the area of four to five gallons using an approximately twenty gallon tumbler with roughly four gallons of pulverizing media (by volume) therein. The exact ratio of pulverizing media to mineral rocks may vary, along with the size of the tumbler and the rotation speed thereof. The numbers stated show but one example that has been demonstrated as an effective implementation of the present invention in a production environment. Speeds between 10-70 RPM have been shown effective for pulverizing rocks using the process of the present invention. The drivetrain assembly 41 of the design prototype, and one contemplated as a configuration falling within the scope of the present invention, comprises a first 44 and second 45 pulley wheel sharing a common shaft, wherein the first pulley wheel 44 is driven by a belt 42 from the power source 40, and the second pulley wheel 45 drives another belt 42 secured to a final drive pulley wheel 43 sharing a common shaft with the input to the tumbler 11. This configuration allows the input to be changed to a specific ratio without compromising the torque input on the tumbler. If the power source comprises an internal combustion engine, the engine can run at an ideal speed while the tumbler rotates at a relatively low RPM. Furthermore, the engine and drivetrain may be coupled by a clutch assembly or controlled by tensioners, whereby the power source can be operably coupled and decoupled from the drivetrain if necessary during start-up and the like.

Figure 2:
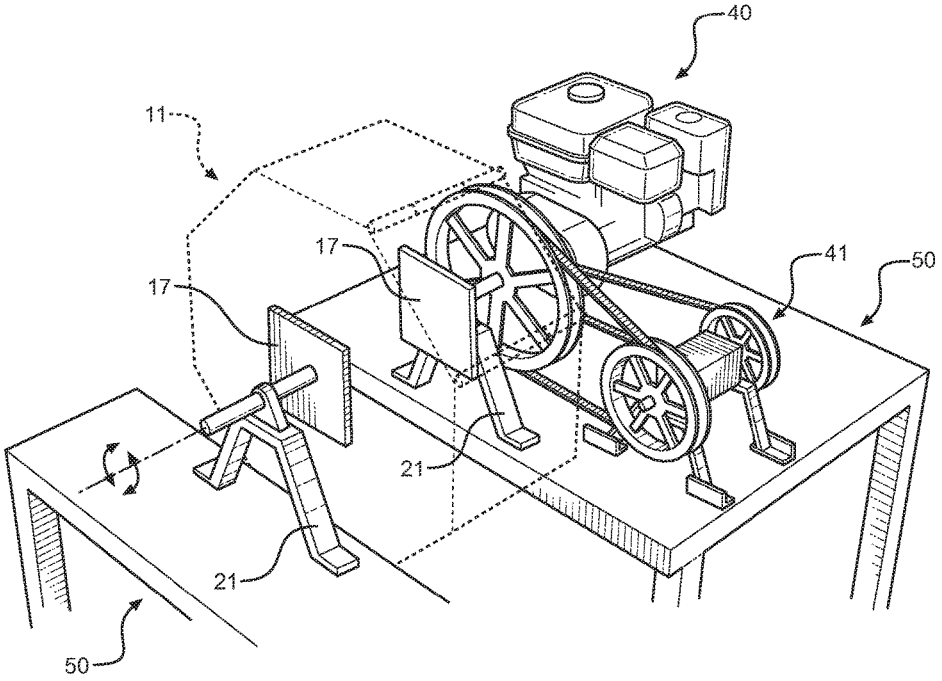
FIG. 2 shows another view of the rock pulverizing assembly of the present invention, wherein the tumbler is shown in broken lines.

Referring now to FIG. 2, there is shown another view of the pulverizing assembly of the present invention, wherein the tumbler 11 is shown in broken lines for clarity. As shown, the output 17 of the drivetrain assembly 41 secures to the sidewalls of the tumbler, whereby an output shaft secures to the tumbler using connection plates, or alternatively the output shaft extends through the central portion of the tumbler. The shaft is supported on both sides of the tumbler via shaft supports 21, which rotatably support the shaft in a stable position using bearings or necessary bushings. Similarly, the drivetrain assembly 41 and power input 40 are sufficiently affixed to a support using appropriate structure such that the assembly remains stable while in operation and during the dynamic motion of the assembly. One contemplated support is a workbench assembly 50, which supports the assembly on a planar surface and positions the tumbler 11 over an opening that provides clearance therefor and allows powder product of the process to flow from the tumbler and into a collection area.

Figure 3:
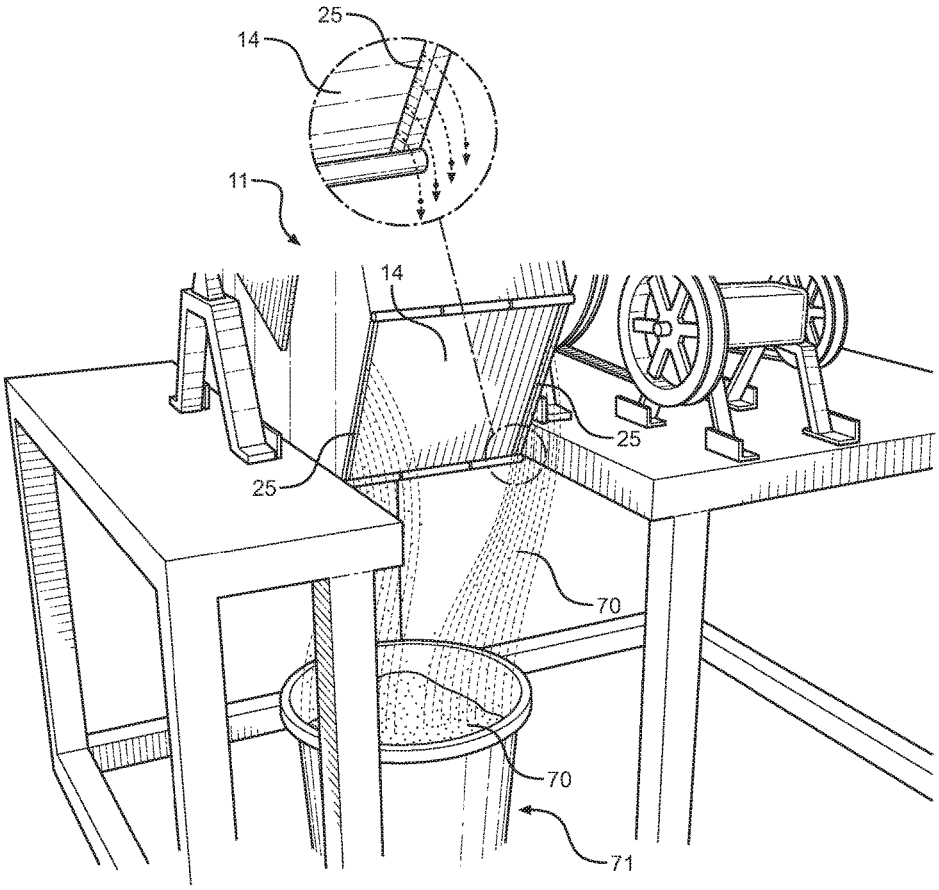
FIG. 3 shows a view of the action of the tumbler depositing pulverized rock minerals from the tumbler interior during operation.

Referring now to FIG. 3, there is shown a crucial aspect of the tumbler while in operation pulverizing the mineral rocks into granular material. As the pulverizing material and tumbler break down the rocks into smaller proportions and eventually into powder form, the interior of the tumbler 11 will fill up with a layer of the powder. This causes the walls of the tumbler to be covered by a layer that is then impacted, as opposed to impacts that are adapted to occur between the rocks and the walls of the tumbler. This causes an attenuation of energy and a reduction in the effectiveness of the process. To address this, the process can be stopped and the tumbler can be emptied of the powder periodically. However, this is time consuming and slows down the overall process from start to finish. Therefore, the present invention contemplates apertures or openings 25 disposed along at least one of the end walls of the tumbler 11.

The openings 25 are adapted to allow fine powder to escape the interior of the tumbler 11 while the same is spinning. The openings 25 may be disposed along the surface of the end walls, or preferably there may be provided a gap between the access door 14 and the sidewalls of the tumbler. As the access door 14 rotates below the rotational center of the tumbler, the powder 70 falls through the openings and into a collection area 71 disposed therebelow. The powder 70 deposits in the collection area and can be processed thereafter. This process reduces the build-up of fine powder in the tumbler and eliminates the need to stop the tumbler operation to clean out the same.

Figure 4:
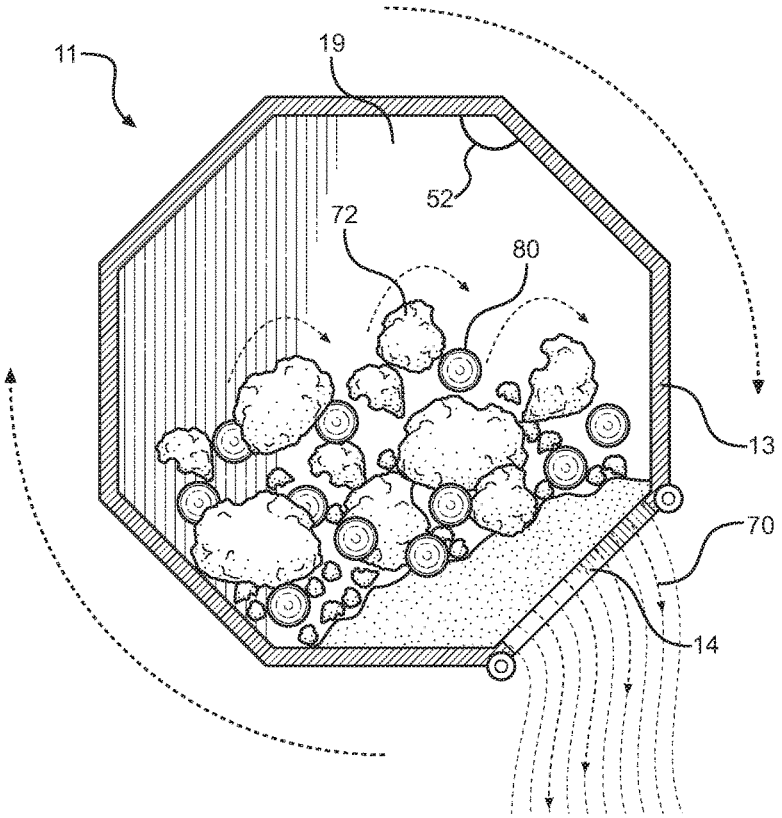
FIG. 4 shows an internal view of the tumbler during operation.

Referring now to FIG. 4, there is shown a cross section view of the tumbler 11 in operation, whereby the tumbler supports a volume of rock minerals 72 and a volume of pulverizing media 80 therein. In operation, the tumbler 11 rotates in a single direction. The internal volume 19 of the tumbler 11 is open and bounded by the faceted sidewalls and end walls 13 thereof. The end walls 13 are preferably planar surfaces joined at their ends at a given angle, whereby curvature along the interior 19 of the tumbler is avoided. The volume 19 of the tumbler 11 is largely unoccupied by the pulverizing media 80 and the rock minerals 72 such that the contents of the tumbler are flung from one side of the tumbler to the other during a rotation. This cases impacts against the walls of the tumbler, against other rocks, and against the pulverizing media. Preferably at least half of the tumbler is unoccupied at the start of the operation, whereby the volume therein will gradually decrease as the rocks are reduced and broken down. During this process, the fine powder 70 created therefrom exits through the openings in the end walls 13 and/or the access door 14 and into a collection area. In the example recited above, rotation of the tumbler for a duration of 2-4 hours creates a steady output of roughly 1.5 gallons of powder per hour for collection.

Figure 5:
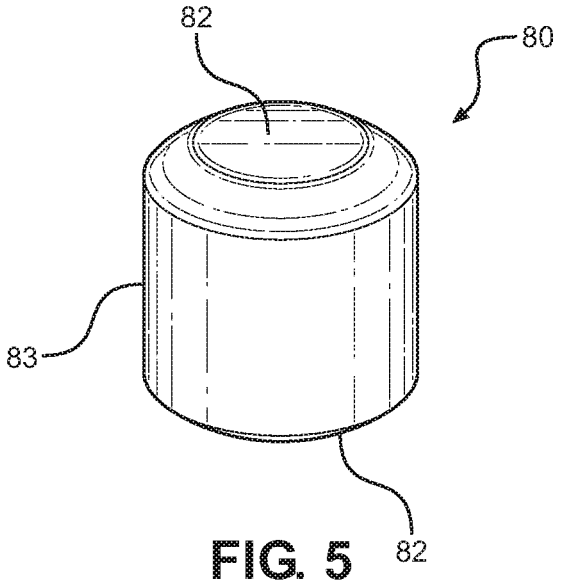
FIG. 5 shows one contemplated embodiment of the pulverizing media, wherein the media comprises hardened pellets.
Figure 6:
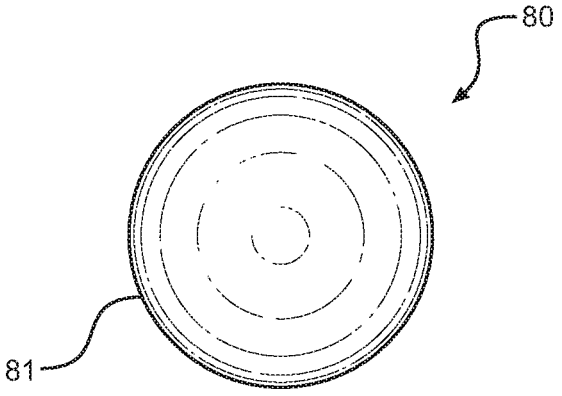
FIG. 6 shows another contemplated embodiment of the pulverizing media, wherein the media comprises hardened spheres.

Referring now to FIGS. 5 and 6, there are shown two contemplated embodiments of the pulverizing media 80 of the present invention. In both embodiments, high strength, high stiffness, and high surface hardness material objects are used in the tumbler. These items are loaded with the mineral rocks in a defined ratio, and reused until pulverized themselves. This generally takes many cycles to occur, however the pulverizing media is a perishable item over the long-term. The first embodiment contemplates sections of round stock material that are cut to form short cylindrical pellets having a rounded outer profile 83 and flat upper and lower surfaces 82. These are metal sections having a higher strength and stiffness than the mineral rock being processed. A second embodiment of the pulverizing media 80 comprises a rounded spherical structure 81. This embodiment is comprised of metal material that comprises a rounded outer profile.

The pulverizing media is mixed with mineral rocks to be broken down within the interior of the tumbler, whereby the assembly efficiently breaks down the rocks into powder form such that a user can further process the powder for precious minerals. In use, rocks are inserted into the tumbler and the motor is run at a slow speed for several hours. Once the cycle is complete, the fine powder is dispensed into a bucket or another suitable container. The tumbler is preferably supported via a shaft on each side thereof, which are secured in position by pillow block bearings for free rotation. Steel balls or round stock media are used as weights to crush the rocks, turning the rocks into a fine powder. The device pulverizes rocks for sluicing in a highly efficient manner while eliminating the need for individuals to manually hammer rocks into smaller pieces. Moreover, the present invention allows users to leave the machine unattended during the process while reducing the amount of time and effort needed to transform rocks into dust.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pulverizing assembly, comprising:

a tumbler having a pair of sidewalls and a plurality of end walls forming an enclosed interior volume;

said end walls and said pair of sidewalls comprising planar surfaces joined at their ends;

wherein said end walls and said pair of sidewalls each lie in separate planes;

an access door through one of said end walls;

a shaft connected to said tumbler;

a power source providing rotational input to said shaft;

a plurality of openings disposed between the pair of sidewalls and said access door, whereby said plurality of openings are configured to permit powdered material to escape said interior volume;

wherein each of the plurality of openings comprise a gap extending along an entire length of a lateral side of the access door when the access door is in a closed position such that powdered material can escape when the tumbler is rotating;

a pulverizing media.

2. The pulverizing assembly of claim 1, wherein:

said end walls abut one another in a faceted configuration and at a given angle;

said end walls each abut said pair of sidewalls at a right angle.

3. The pulverizing assembly of claim 2, wherein the given angle between each of the end walls is 45-degrees.

4. The pulverizing assembly of claim 1, wherein said power source comprises an internal combustion engine and a drivetrain assembly.

5. The pulverizing assembly of claim 1, wherein said power source comprises an electric motor.

6. The pulverizing assembly of claim 1, wherein said pulverizing media further comprises a plurality of spherical structures.

7. The pulverizing assembly of claim 1, wherein said pulverizing media further comprises a plurality of round stock material having a cylindrical profile and a substantially flat upper and lower surface.

8. The pulverizing assembly of claim 7, wherein an upper end of the cylindrical profile tapers towards the upper surface and a lower end of the cylindrical profile tapers towards the lower surface, such that a diameter of the upper surface and the lower surface is less than a diameter of the cylindrical profile.

9. The pulverizing assembly of claim 1, wherein the axis of the rotational input is perpendicular to the pair of sidewalls.

10. The pulverizing assembly of claim 1, further comprising a workbench assembly comprising a pair of planar surfaces separated by a distance, wherein opposing ends of the shaft are supported on each of the planar surfaces, such that the tumbler is supported therebetween allowing the tumbler to discharge the powder material into a collection area disposed below the workbench assembly.

11. The pulverizing assembly of claim 10, further comprising a pair of shaft supports, wherein the pair of shaft supports each comprise an A-shaped frame having a pair of legs configured to rest flush on the pair of planar surfaces.

12. A method of pulverizing mineral rocks using a tumbler assembly, comprising the steps of:

loading a faceted tumbler, having a plurality of end walls and a pair of sidewalls, wherein said end walls and sidewalls are planar surfaces joined at their ends which each lie in separate planes, with mineral rocks and a pulverizing media such that at least half of said faceted tumbler is unoccupied;

rotating said faceted tumbler using a power input at a given rotational speed;

allowing powder from said mineral rocks to escape said faceted tumbler through a plurality of openings disposed between the pair of sidewalls an access door, wherein the access door is disposed through one of said end walls;

wherein the plurality of openings comprise a gap extending along an entire length of a lateral side of the access door when the access door is in a closed position such that powdered material can escape when the tumbler is rotating;

collecting said powder from said plurality of openings.

13. The method of claim 12, wherein said given rotational speed is between 10-70 revolutions per minute.

* * * * *